US008574401B2

(12) United States Patent
Andersson et al.

(10) Patent No.: US 8,574,401 B2
(45) Date of Patent: Nov. 5, 2013

(54) APPARATUS FOR INSERTING OR REMOVING A CLOTHING IN AN INDUSTRIAL MACHINE

(75) Inventors: Dan Andersson, Karlstad (SE); Göran Ekström, Väse (SE)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 13/508,306

(22) PCT Filed: Nov. 25, 2009

(86) PCT No.: PCT/SE2009/051337
§ 371 (c)(1),
(2), (4) Date: Jun. 12, 2012

(87) PCT Pub. No.: WO2011/056113
PCT Pub. Date: May 12, 2011

(65) Prior Publication Data

US 2012/0247703 A1 Oct. 4, 2012

Related U.S. Application Data

(60) Provisional application No. 61/258,884, filed on Nov. 6, 2009.

(51) Int. Cl.
*D21F 1/32* (2006.01)

(52) U.S. Cl.
USPC ..... 162/199; 162/272

(58) Field of Classification Search
USPC ..... 162/199, 272, 273; 29/402.01, 402.08, 29/402.11
See application file for complete search history.

(56) References Cited

U.S. PATENT DOCUMENTS

| | | | | |
|---|---|---|---|---|
| 3,600,273 A | | 8/1971 | McCarrick et al. | |
| 4,481,078 A | * | 11/1984 | Niemi | 162/199 |
| 4,608,125 A | * | 8/1986 | Autio | 162/273 |
| 4,657,634 A | * | 4/1987 | Autio | 162/199 |

(Continued)

FOREIGN PATENT DOCUMENTS

| | | |
|---|---|---|
| EP | 2 063 022 A1 | 5/2009 |
| EP | 2 063 023 A2 | 5/2009 |

(Continued)

OTHER PUBLICATIONS

International Search Report and Written Opinion, mailed Jul. 29, 2010, of corresponding international application No. PCT/SE2009/051337, filed Nov. 25, 2009.

*Primary Examiner* — Mark Halpern
(74) *Attorney, Agent, or Firm* — Alston & BirdLLP

(57) ABSTRACT

An apparatus (24) for inserting an endless, flexible clothing (15) in or removing such a clothing from an industrial machine in which the clothing is arranged to run in an endless loop, comprising first and second units (25, 26) between which the clothing is to be fed in an advancement direction (F) essentially transversal to the run direction of the clothing in the machine. According to the invention the apparatus comprises an upstream zone (A), an intermediate zone (B) and a downstream zone (C) along the advancement direction of the clothing; and also a member (29) for bringing the units to interact in the first zone and the third zone, alternately, such that the clothing is locked between the units in the first zone and the third zone, alternately, allowing the feeding of the clothing into the upstream zone when the clothing is locked between the units in the downstream zone such that the clothing is accumulated in the intermediate zone, and allowing the feeding of the clothing accumulated in the intermediate zone into the downstream zone when the clothing is locked between the units in the first zone such that the clothing is fed out of the apparatus through the downstream zone (C).

30 Claims, 16 Drawing Sheets

(56) References Cited

U.S. PATENT DOCUMENTS

| | | | | |
|---|---|---|---|---|
| 4,699,692 | A * | 10/1987 | Autio | 162/199 |
| 6,136,149 | A * | 10/2000 | Vallius | 162/199 |
| 6,517,681 | B1 * | 2/2003 | Koskinen et al. | 162/199 |
| 7,900,330 | B2 * | 3/2011 | Vainio et al. | 29/402.08 |

FOREIGN PATENT DOCUMENTS

| | | |
|---|---|---|
| WO | WO 99/55956 | 11/1999 |
| WO | WO 2006/106178 A1 | 10/2006 |
| WO | WO 2007/144459 A1 | 12/2007 |
| WO | WO 2008/129131 A1 | 10/2008 |

* cited by examiner

III-III

APPARATUS FOR INSERTING OR REMOVING A CLOTHING IN AN INDUSTRIAL MACHINE

CROSS REFERENCE TO RELATED APPLICATIONS

This application is a national stage application filed under 35 U.S.C. 371 International Application No. PCT/SE2009/051337, filed Nov. 25, 2009, which claims priority to U.S. Provisional Application No. 61/258,884, filed Nov. 6, 2009, all of which are hereby Incorporated by reference in their entirety.

BACKGROUND OF THE INVENTION

The invention relates to an apparatus for inserting an endless, flexible clothing in or removing such a clothing from an industrial machine in which the clothing is arranged to run in an endless loop, comprising:

a first structural unit and a second structural unit being arranged opposite to each other, said apparatus being arranged to feed the clothing between the first unit and the second unit in a clothing advancement direction essentially transversal to the run direction of the clothing in the machine.

The invention also relates to an industrial machine comprising a flexible clothing running in an endless loop and such an apparatus for inserting the clothing in or removing the clothing from the machine. Such an industrial machine can for example be a paper web forming or processing machine.

The invention also relates to a method of inserting an endless, flexible clothing in or removing such a clothing from an industrial machine.

The invention also relates to the use of such an apparatus in an industrial machine, in which case the apparatus may be an integrated part of the machine or a separate mobile unit.

In this application the term "clothing" is understood to have a relatively wide meaning. In particular, the term "clothing" is understood to represent any type of relatively thin, flexible member that is intended to run in an endless loop in the industrial machine. For example, the clothing can be a felt, a fabric, a belt, e.g. a conveyor belt, a band or a wire. The clothing may alternatively be made of a plurality of flat elements interconnected to form a band. The clothing may be made of a polymer, a metal or a composite material. The clothing may be woven or non-woven. Typically, the clothing is used to support or transport some kind of product in the machine.

In particular, the invention relates to an apparatus for inserting or removing, i.e. mounting or demounting, an endless clothing in a web forming or web processing machine. In a web forming or processing machine, such as for example a papermaking machine, a tissue machine, a pulp processing machine or a paperboard making machine, the web is led through the machine by at least one clothing that runs in an endless loop over a plurality of support rolls suspended in a frame of the machine. The clothing can be a felt, a fabric, a belt, a band, a wire or any other type of thin, flexible member that is intended to carry, imprint or otherwise interact with the web during its travel through the machine. The clothing can be made of polymer, metal or composite material. The clothing can be wide and also relatively heavy. For example, a clothing in a web forming or web processing machine can be up to 10 to 12 m wide.

When mounting a clothing in a web forming or processing machine, it is possible to mount a clothing having two ends in the machine and to connect the ends of the clothing once the clothing has been fitted in the machine. Consequently, when such a clothing is used, a seam or a joint between the ends needs to be constructed, which is relatively time consuming. Furthermore, seams or joints may cause unacceptable markings in the web. Therefore, a clothing for use in a web forming or processing machine is usually prefabricated such that it forms an endless loop. When replacing such an endless clothing, which has to be done relatively often due to its wear, e.g. every 3 to 6 months in the case of forming wires and every 3 to 10 weeks in the case of press section felts, the new clothing must be mounted from the side of the machine, i.e. either from the drive side or from the tender side. Normally the tender side offers the most space for such an operation.

However, when using this kind of sideways or cross direction (CD) replacement method the obvious problem arises of getting the clothing through the frame structure in which the support rolls are suspended.

A known solution to this problem is to provide the vertical beams on the tender side of the frame with removable spacer blocks. When a clothing is to be replaced, a counter-lever system on the drive side of the frame is utilized to unload the vertical beams on the tender side. After unloading the vertical beams, the spacer blocks are removed and the clothing can then be replaced through the gaps thus formed in the frame structure. Although cantilevering is a robust solution, it is desirable to find an alternative since its implementation is space consuming and also cost demanding.

An alternative to cantilevering is disclosed in WO 2006/106178 A1 and WO 2008/129131 A1, where units comprising counter revolving bands and/or sliding surfaces are arranged in the vertical beams. When a clothing is to be passed through the beam, the clothing is fed into the nip between the bands or the sliding surfaces of the unit and is brought to the other side of the beam, either manually or by a rotational movement of at least one band of the unit. Another alternative to cantilevering is disclosed in EP 2 063 023 A2, where units comprising pulling devices are arranged in the vertical beams. When a clothing is to be passed through the beam, the clothing is fed in between the pulling devices, after which the clothing is locked between the pulling devices and the pulling devices pull the clothing through the beam.

Although the disclosed units do require very little space, the devices disclosed in WO 2006/106178 A1, WO 2008/129131 A1 and EP 2 063 023 A2 are relatively technically complicated and thus also expensive to fabricate. Furthermore, in the disclosed devices the clothing is brought through the beam while being loaded by the forces acting on the beam. In other words, the part of the clothing which is brought through the beam is subjected to the full weight of the beam. Consequently, the part of the clothing which is brought through the beam is simultaneously subjected to a shearing force due to the advancing movement of the band/sliding surface/pulling device, and to a normal force due to the weight of the beam. This is, however, an unfavourable loading condition which may damage the clothing.

One objective of the invention is to provide an improved method and an improved system which do not display these drawbacks. Another objective of the invention is to provide a method and a system which enable operators to replace a clothing in an industrial machine, and in particular in a web forming or processing machine, in a fast and easy manner without having to risk damaging the clothing.

SUMMARY OF THE INVENTION

The apparatus according to the invention is characterized in that it comprises:

an upstream zone (A), an intermediate zone (B) and a downstream zone (C) being arranged one after the other along the advancement direction (F) of the clothing (15); and at least one first member (10, 11, 29, 36, 37) being arranged for bringing the first unit (6, 25, 34) and the second unit (7, 26, 35) to interact with each other in the upstream zone (A) and the downstream zone (C), alternately, such that the clothing (15) is arrested between the first unit (6, 25, 34) and the second unit (7, 26, 35) in the upstream zone (A) and the downstream zone (C), alternately, allowing the feeding of a predetermined breadth of the clothing (15) into the upstream zone (A) when the clothing (15) is arrested between the first unit (6, 25, 34) and the second unit (7, 26, 35) in the downstream zone (C) such that a breadth of clothing (15) equivalent to said predetermined breadth of clothing (15) is accumulated in the intermediate zone (B), and allowing the feeding of the clothing (15) accumulated in the intermediate zone (B) into the downstream zone (C) when the clothing (15) is arrested between the first unit (6, 25, 34) and the second unit (7, 26, 35) in the upstream zone (A) such that a breadth of clothing equivalent to said predetermined breadth of clothing (15) is fed out of the apparatus (5, 24, 33, 45) through the downstream zone (C).

BRIEF DESCRIPTION OF SEVERAL VIEWS OF THE DRAWINGS

For a better understanding of the invention, and to show how embodiments of the invention are to be carried out, reference will now be made, by way of example only, to the accompanying schematic drawings in which.

DETAILED DESCRIPTION OF THE INVENTION

Figure 1:
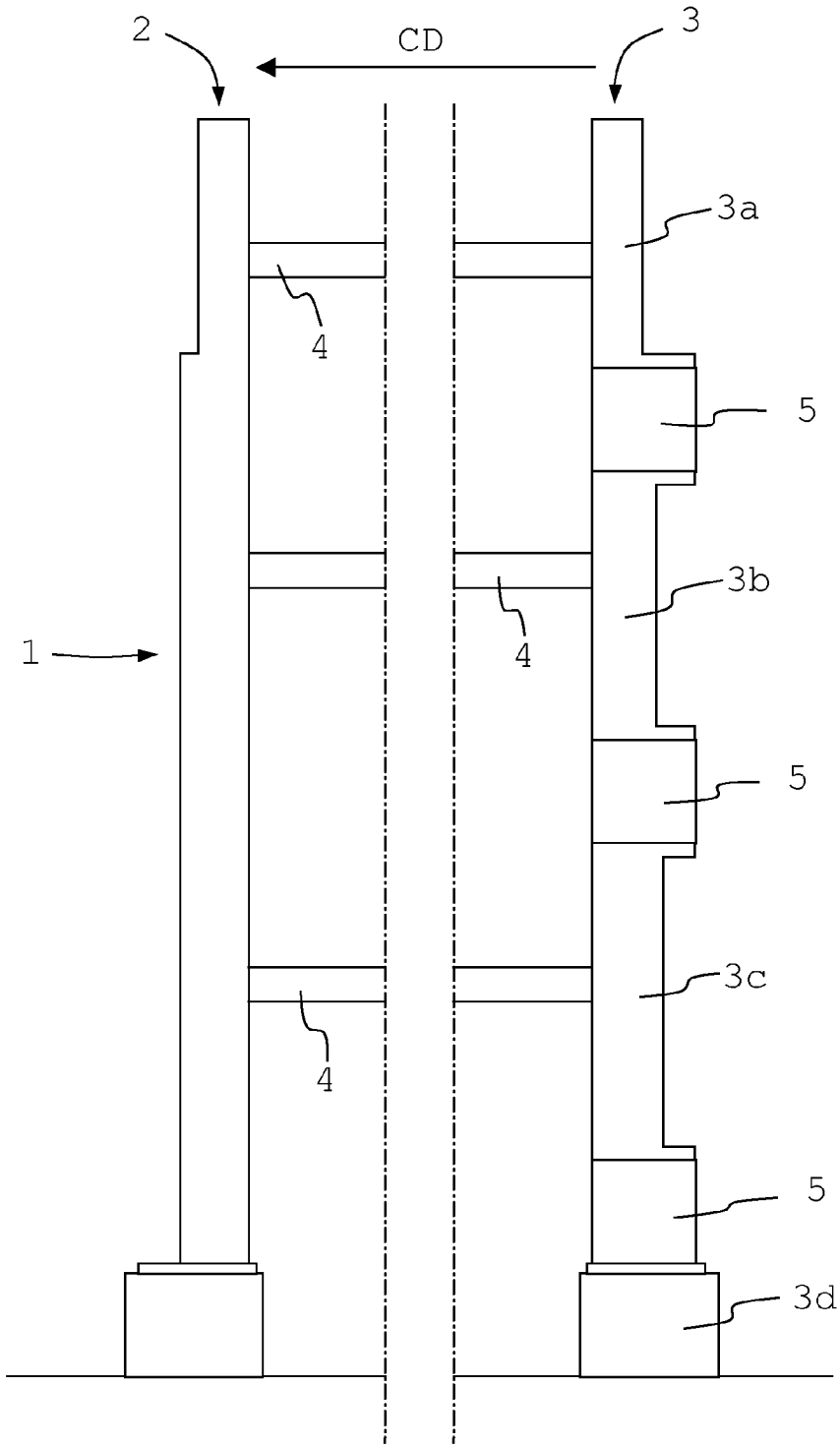
FIG. 1 is a schematic, cross-sectional view of a section of a frame of a papermaking machine comprising three apparatus according to the invention.

FIG. 1 is a cross-sectional view of a section of a frame structure 1 of a papermaking machine. The frame structure 1 is part of a processing section of the papermaking machine, e.g. a forming section or a press section. The frame structure 1 comprises a drive side vertical beam 2 and a tender side vertical beam 3. The frame structure 1 also comprises cross-directional, CD, horizontal beams 4 which run between the vertical beams 2 and 3.

Support rolls (not shown) are rotatably supported by the beams 2, 3 of the frame structure 1. Consequently, the beams 2, 3 act as carrier beams for the support rolls. The support rolls are arranged to guide or carry or otherwise support a flexible clothing (not shown in FIG. 1) in an endless loop as is well known in the art of papermaking. The clothing, in turn, is arranged to lead a web (not shown) through the processing section as is well known in the art of papermaking.

The vertical beam 3 on the tender side of the frame structure 1 comprises a plurality of clothing exchange apparatus 5 according to the present invention. In this case there are three apparatus 5 and consequently the beam 3 is divided into four sections 3*a*, 3*b*, 3*c* and 3*d*, which are separated by an apparatus 5.

Alternatively, depending on the run of the clothing in the papermaking machine, the vertical beam 3 may comprise one, two or any other number of apparatus 5. For example, when only one clothing is used, it may be sufficient with only one apparatus 5 per vertical beam 3.

Figure 2A:
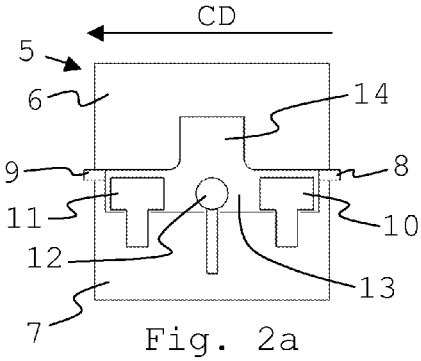
FIGS. 2*a* to 2*w* are schematic, cross-sectional views showing the operation of a two-actuator apparatus according to one embodiment of the invention.
Figure 2B:
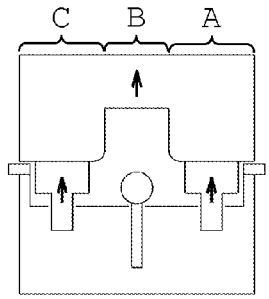
Figure 2C:
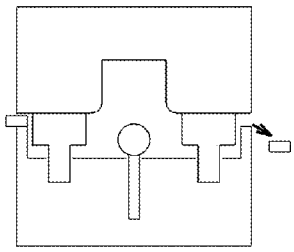
Figure 2D:
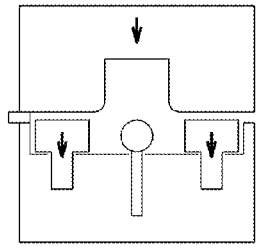
Figure 2E:
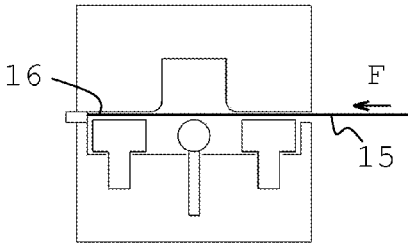
Figure 2F:
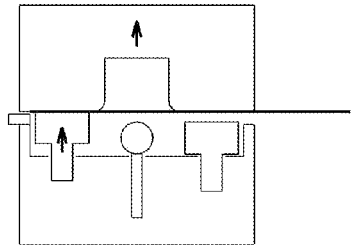
Figure 2G:
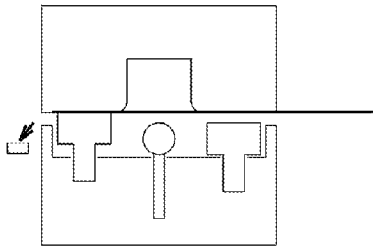
Figure 2H:
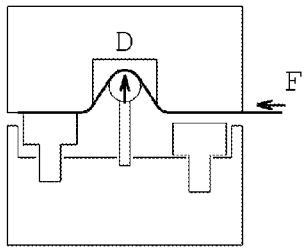
Figure 2I:
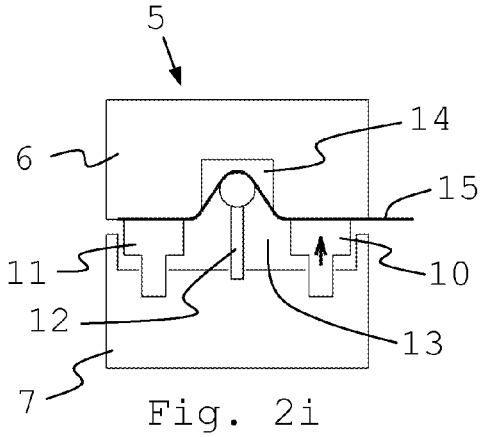
Figure 2J:
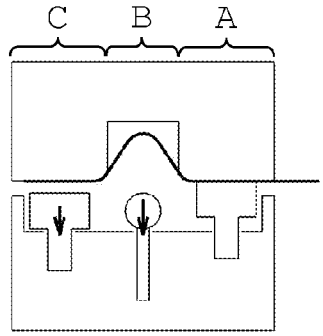
Figure 2K:
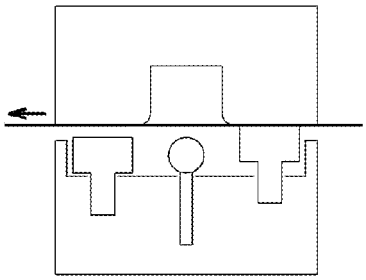
Figure 2L:
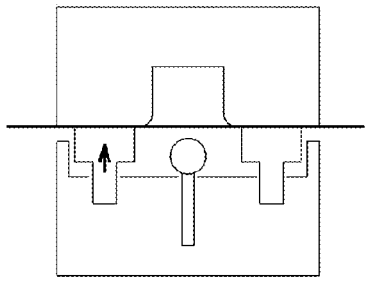
Figure 2M:
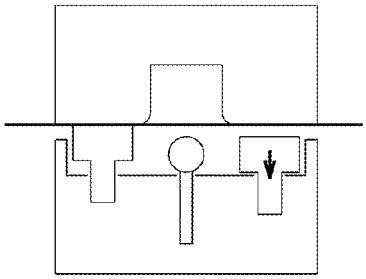
Figure 2N:
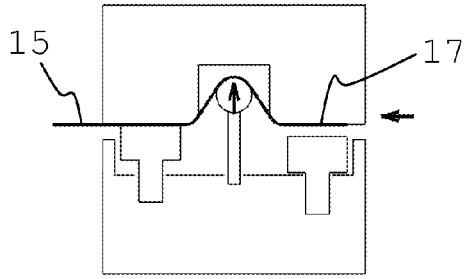
Figure 2O:
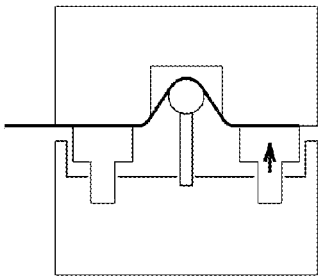
Figure 2P:
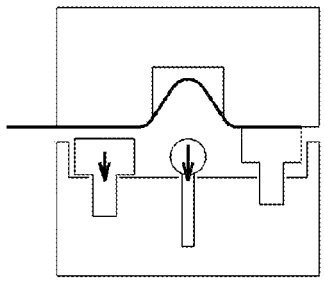
Figure 2Q:
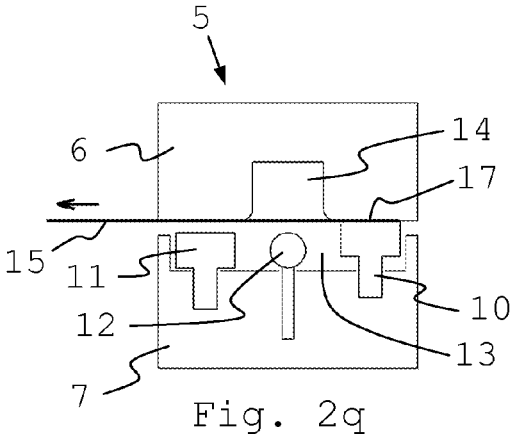
Figure 2R:
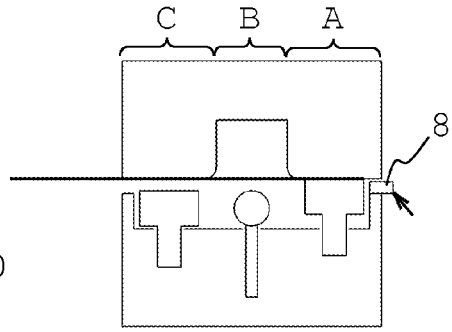
Figure 2S:
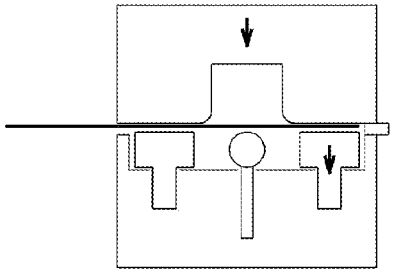
Figure 2T:
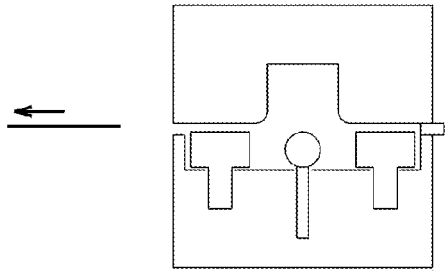
Figure 2U:
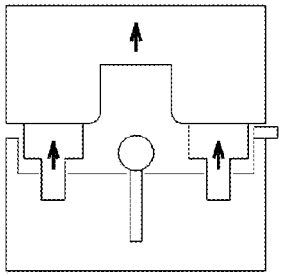
Figure 2V:
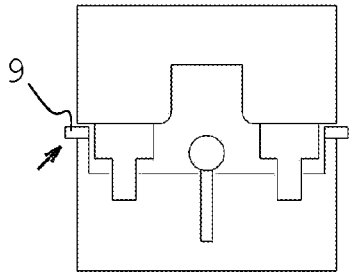
Figure 2W:
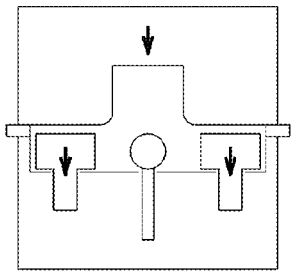

FIGS. 2*a* to 2*w* show a first embodiment of an apparatus 5 according to the invention. The apparatus 5 comprises a first, upper unit 6 and a second, lower unit 7. The upper unit 6 is rigidly attached to an upper section of the vertical beam 3. If used in the frame structure 1 of FIG. 1, this upper section may be 3*a*, 3*b* or 3*c*, depending on the position of the apparatus 5. The lower unit 7 is rigidly attached to the corresponding lower section 3*b*, 3*c* or 3*d* of the beam 3. The apparatus 5 also comprises a first, outer spacer 8 and a second, inner spacer 9, which spacers 8, 9 are arranged between the upper and lower units 6, 7 when the apparatus 5 is inactive.

In the cross direction, CD, the apparatus 5 is divided into a first, outer section or zone A, a second, middle section or zone B and a third, inner section or zone C (see FIGS. 2*c*, 2*j* and 2*r*).

The lower unit 7 comprises a first, outer actuator 10 arranged in the outer zone A and a second, inner actuator 11 arranged in the inner zone C. The lower unit also comprises a clothing advancement unit which is arranged in the middle zone B. The clothing advancement unit comprises a clothing manipulator 12. The actuators 10 and 11 and the clothing manipulator 12 are arranged in an upwardly open recess 13 in the lower unit 7. Opposite the clothing manipulator 12, the upper unit 6 comprises a downwardly open recess 14. Consequently, the distance between the units 6 and 7 is larger in the middle zone B than in the outer and inner zones A and C.

The operation of the apparatus 5 will be described in the following with reference to FIGS. 2*a* to 2*w*, whereby it is assumed that the apparatus 5 is mounted in a vertical beam of a frame of a web forming or web processing machine and that a clothing in a processing section of the machine is to be replaced.

FIG. 2*a* shows the apparatus 5 in an inactive position prior to a clothing replacement operation. In this position the load of the upper beam section is transferred to the lower beam section via the upper unit 6, the spacers 8 and 9 and the lower unit 7.

Before a new clothing can be mounted in the processing section of the paper machine, the old clothing has to be removed. This can be done by an operator cutting the old clothing and running the clothing out of the processing section using the support rolls of the processing section. Alternatively, the old clothing can be removed by using the apparatus 5 in a reversed mode, as will be disclosed later.

When the old clothing has been removed from the processing section, the initial phase of the advancement operation of the new clothing can commence. The operator raises the inner and outer actuators 10 and 11 in such a way that the actuators 10 and 11 are brought in contact with the upper unit 6 and raise the upper unit 6, as is shown in FIG. 2*b*, unloading the spacers 8 and 9. Thereafter, the operator removes the outer spacer 8, as is shown in FIG. 2*c*, and lowers the actuators 10 and 11, as is shown in FIG. 2*d*, whereby the upper unit 6 comes to rest on the inner spacer 9. Thereafter, the operator feeds the new clothing 15 in an advancement direction F (see FIG. 2*e*) into the gap formed between the upper and lower units 6 and 7 such that the drive side edge 16 of the new clothing 15 is brought between the inner actuator 11 and the upper unit 6, and preferably in contact with the inner spacer 9, as is shown in FIG. 2*e*. Thereafter, the operator raises the inner actuator 11 in such a way that the inner actuator 11 is brought to interact with opposite surface of the upper unit 6 and such that the inner actuator 11 is brought in contact with the clothing 15, locking the clothing 15 between the actuator 11 and the upper unit 6 and raising the upper unit 6, as is shown in FIG. 2*f*, thus unloading the inner spacer 9. Thereafter, the operator removes the inner spacer 9, as is shown in FIG. 2*g*, which step concludes the initial phase of the clothing advancement operation.

In the second phase of the clothing advancement operation, a series of steps are performed that define a pull-push cycle which is repeated until the tender side edge 17 (see FIG. 2*n*) of the clothing 15 is pulled into the apparatus 5. At the start of the second phase, the situation is as shown in FIG. 2*g*, i.e. the upper unit 6 and the lower unit 7 are brought to cooperate in the inner zone C such that the load of the beam is carried by the apparatus 5 in the third zone C only and the clothing 15 is locked between the actuator 11 and the upper unit 6. The first step in the second phase is shown in FIG. 2*h*. The clothing manipulator 12 is raised in a direction D such that the clothing manipulator 12 is brought into the recess 14 of the upper unit 6. Since the clothing 15 is locked between the inner actuator 11 and the upper unit 6 and since the direction D is essentially orthogonal to the advancement direction F, the raising of the clothing manipulator 12 will cause the clothing 15 outside of the frame section 1 to be pulled into the first and second zones A and B of the apparatus 5, as is shown in FIG. 2*h*. Thus, the clothing manipulator 12 acts as a pull actuator, pulling a predetermined length of the clothing into the apparatus 5 when it is operated in the direction D, i.e. when it is raised. Next, the operator raises the outer actuator 10 such that it is brought to interact with the upper unit 6 and in such a way that the outer actuator 10 is brought in contact with the clothing 15, whereby the clothing 15 is locked between the actuator 10 and the upper unit 6, as is shown in FIG. 2*i*. Thereafter, the inner actuator 11 and the clothing manipulator 12 are lowered, as is shown in FIG. 2*j*. When the inner actuator 11 is lowered, the load of the beam is transferred from the third zone C to the first zone A and the clothing 15 in the third zone C is released. When the clothing manipulator 12 is lowered, the clothing 15 will normally automatically strive to recover its flat form due to the inherent stiffness and elasticity of the clothing 15, causing the drive side of the clothing 15 to be pushed out of the apparatus 5, as is shown in FIG. 2*k*. However, the operator may have to assist this step by pulling on the drive end of the clothing 15. Alternatively, the advancement element may comprise a second clothing manipulator in the form of a push actuator (not shown), which is arranged in the upper unit opposite to the first clothing manipulator 12 and is arranged to actively push the clothing out of the apparatus 5 by means of a downward motion. When the clothing 15 has been pushed out of the apparatus 5 and, consequently, has recovered its flat form, the inner actuator 11 is again raised, as is shown in FIG. 21, and the outer actuator 10 is lowered, as is shown in FIG. 2*m*, bringing the apparatus 5 to the same position as in FIG. 2*g*. The pull-push sequence or cycle shown in FIGS. 2*h* to 2*m* is repeated until the tender side 17 of the clothing 15 is pulled into the apparatus 5, as is shown in FIGS. 2*n* to 2*q*, at which point the second phase of the clothing advancement operation has been carried through.

In the third and final phase of the advancement operation, the outer spacer 8 is placed in its original position, as is shown in FIG. 2*r*, and the outer actuator 10 is lowered, as is shown in FIG. 2*s*. This leaves the upper unit 6 resting on the outer spacer 8 and allows the operators to pull the trailing end of the clothing 15 out of the apparatus 5, as is shown in FIG. 2*t*. Finally, the operators reinstitute the inactive position of the apparatus 5 by raising the upper unit 6 by means of raising the actuators 10 and 11, as is shown in FIG. 2*u*, placing the inner spacer 9 in its original position, as is shown in FIG. 2*v*, and lowering the actuators 10 and 11, leaving the upper unit 6 to rest on the spacers 8 and 9, as is shown in FIG. 2*w*.

As seen in the clothing advancement direction F, the first zone A forms an upstream zone, the second zone B forms an intermediate zone and the third zone C forms a downstream zone of the apparatus 5, and the clothing advancement operation according to the invention comprises repeating the sequence of:

- locking the clothing 15 between the upper unit 6 and the lower unit 7 in the downstream zone C and releasing the clothing 15 in the upstream zone A;
- feeding the clothing 15 into the upstream zone A and accumulating the clothing 15 in the intermediate zone B;
- locking the clothing 15 between the upper unit 6 and the lower unit 7 in the upstream zone A and releasing the clothing 15 in the downstream zone C; and
- feeding the clothing 15 accumulated in the intermediate zone B into the downstream zone C and out of the apparatus 5.

Consequently, in order to transfer the load upon the apparatus between the upstream zone A and the downstream zone C, the actuators 10 and 11 are operated back and forth in an operating direction which is essentially orthogonal to the advancement direction F of the clothing 15.

It is understood that the steps of feeding the clothing 15 into and out of the apparatus can be accomplished manually by operators pushing and pulling the clothing 15. However, it is preferred that at least the step of bringing the clothing into the apparatus is aided by some kind of pushing or pulling device, e.g. the above-described clothing manipulator 12.

It is understood that all or some of these steps can be automated such that no or limited operator input is required. Also understood is that the step of feeding the clothing out of the apparatus can be accomplished by means of the inherent elasticity of the clothing.

Figure 3A:
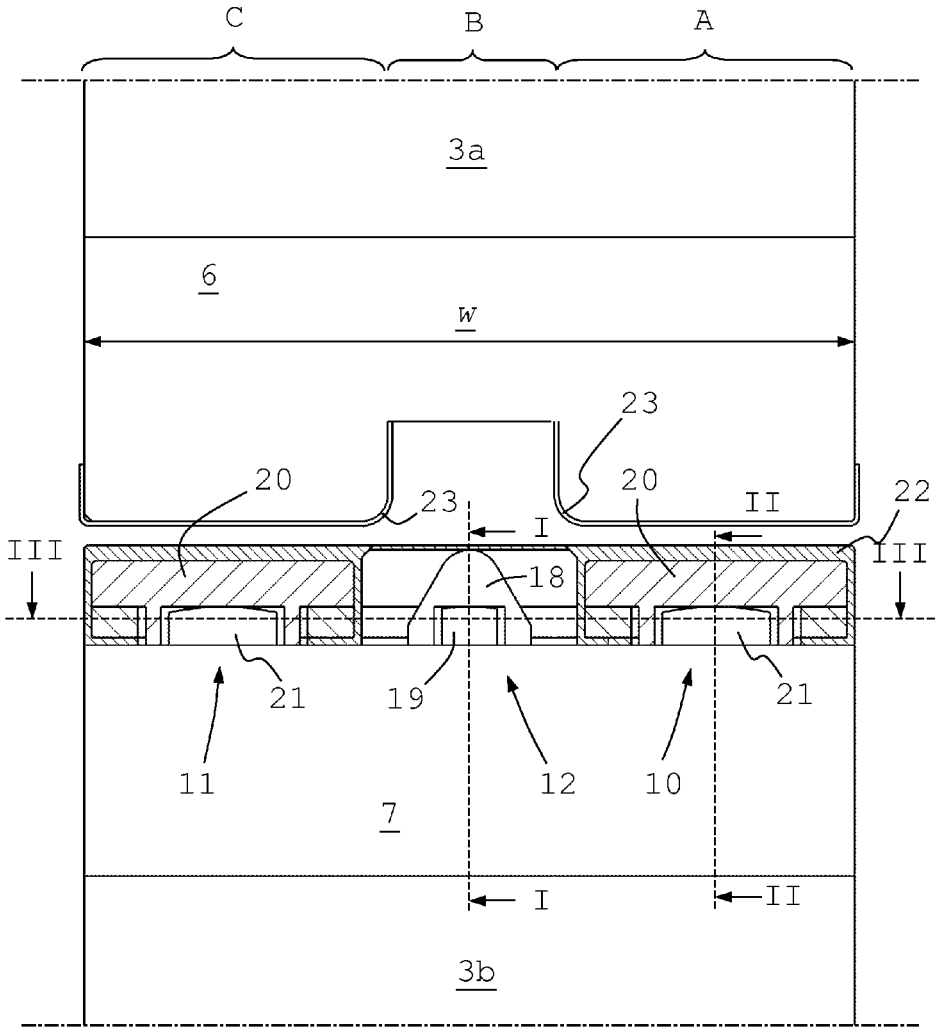
FIGS. 3*a* to 3*e* are cross-sectional views of a two-actuator apparatus according to a preferred embodiment of the invention.
Figure 3B:
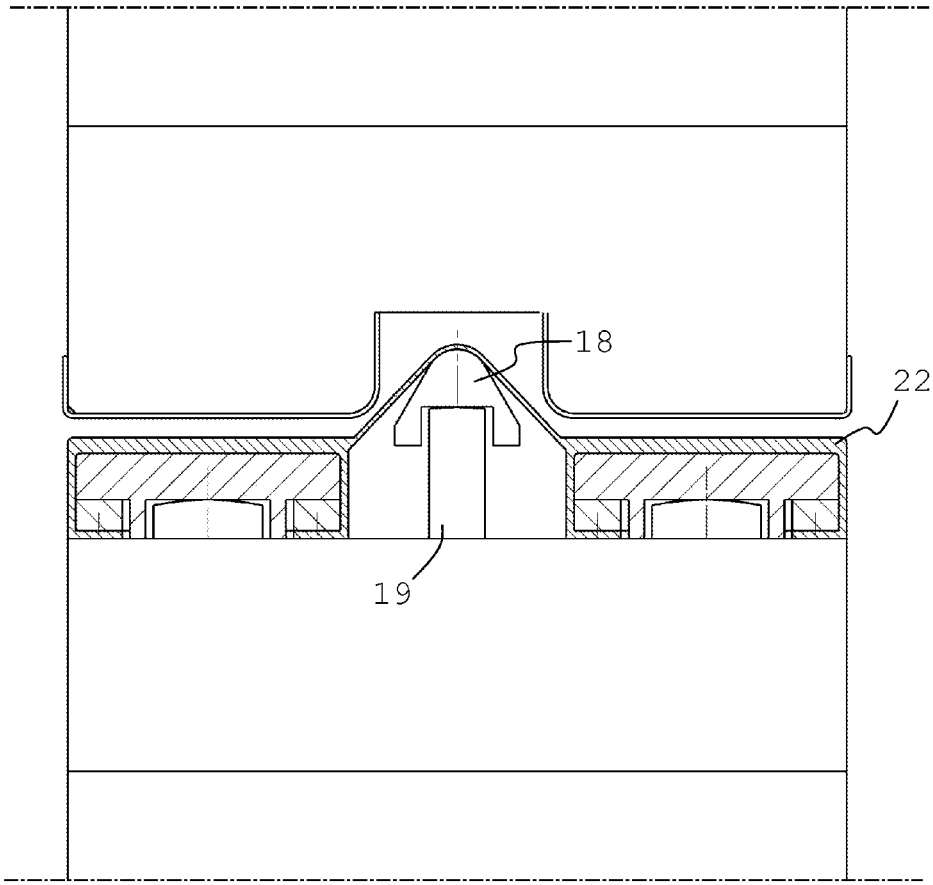
Figure 3C:
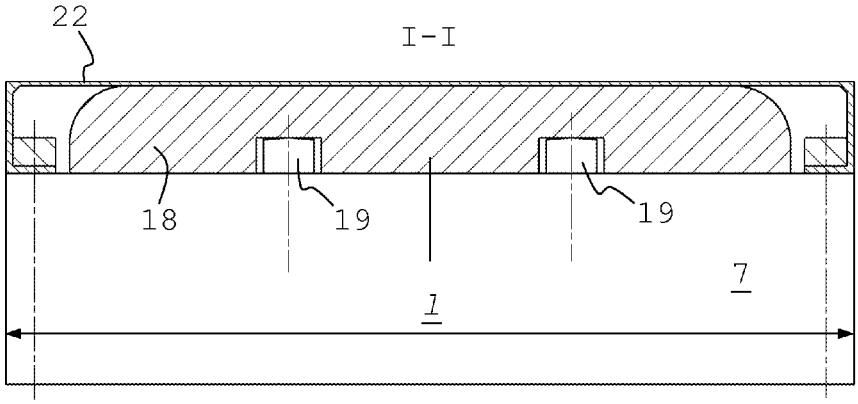
Figure 3D:
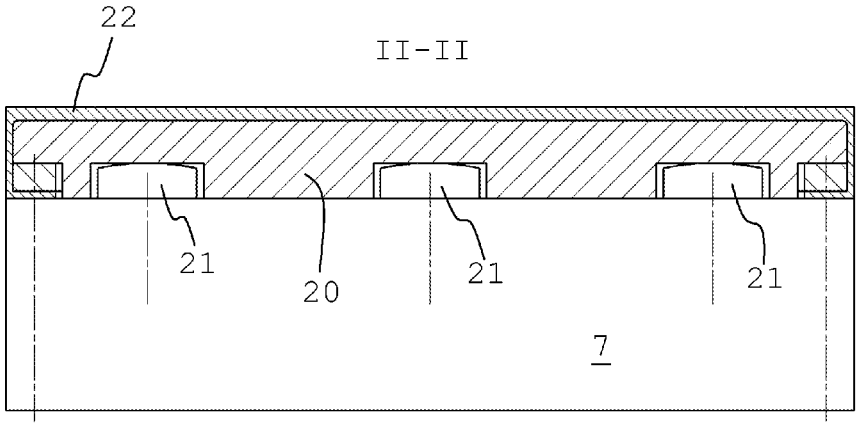

FIGS. 3*a* to 3*e* show a preferred embodiment of an apparatus 5 of the type described above in relation to FIGS. 2*a* to 2*w*. FIGS. 3*a* and 3*b* are vertical and partial sectional views of the apparatus 5 as viewed in the machine direction of the paper machine. FIGS. 3*c* and 3*d* are vertical and partial sectional views of the apparatus 5 as viewed in the cross direction of the paper machine. FIG. 3*c* is a partial sectional view showing the apparatus 5 along the section marked I-I in FIG.

Figure 3E:
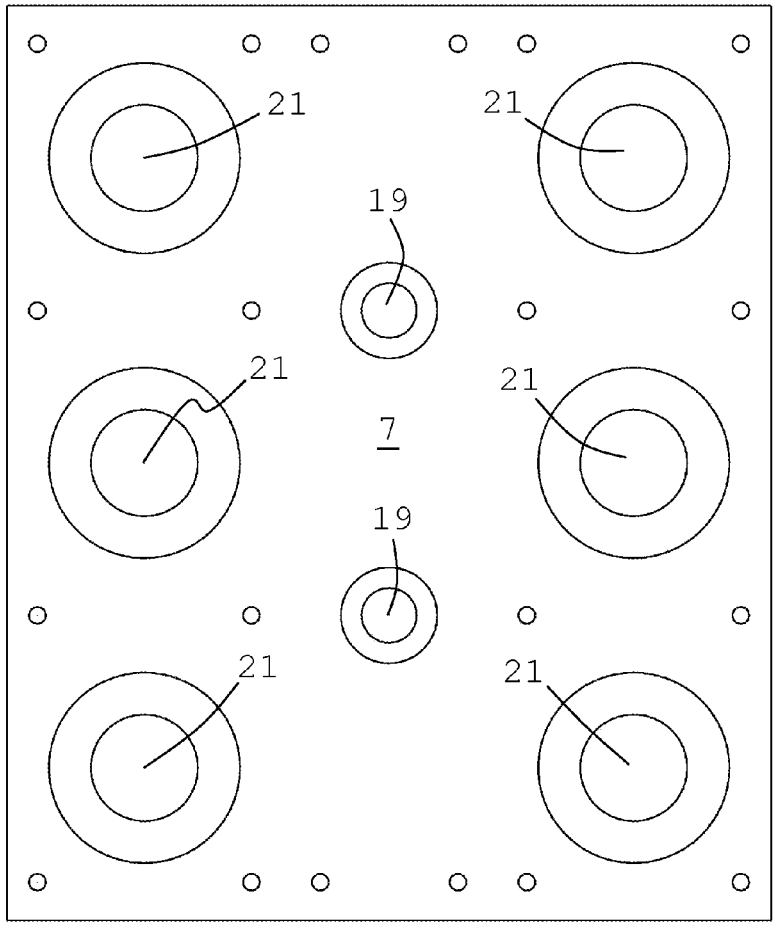

3*a*. FIG. 3*d* is a partial sectional view showing the apparatus 5 along the section marked II-II in FIG. 3*a*. FIG. 3*e* is a partial sectional view showing the apparatus 5 along the section marked III-III in FIG. 3*a*.

The bodies of the upper and lower units 6 and 7 are preferably made from blocks of steel. The width w of the units 6, 7 (see FIG. 3*a*), i.e. the dimension of the units 6, 7 in the cross direction of the apparatus 5, and the length l of the units 6, 7 (see FIG. 3*c*), i.e. the dimension of the units 6, 7 in the machine direction of the apparatus 5, typically match the width and length of the cross-section of the vertical beam in which the apparatus 5 is to be mounted. Typically, the width w and the length l (see FIGS. 3*a* and 3*c*, respectively) are both within the range of 500 to 600 mm.

The lower unit 7 comprises attachment means for the actuators 10 and 11 and the clothing manipulator 12. The manipulator 12 comprises an elongated actuator member 18 that has a convex upper cross-section profile, as can be seen in FIG. 3*a*. In order not to damage the clothing during the advancement operation, the convex tip of the actuator member 18 has a radius which prevents the clothing from being damaged during the above-described raising of the clothing manipulator, i.e. during the pull phase of the pull-push cycle or, equivalently, the in-feed step of the above-described clothing advancement sequence. Typically, this radius is within the range of 50 to 100 mm. The length of the actuator member 18 is preferably somewhat less than the length l of the unit 7. Typically, the length of the actuator member 18 is within the range of 80 to 90% of the length l of the unit 7. The actuator member 18 is preferably made of a high density polymer (HDP). The clothing manipulator 12 comprises two hydraulic cylinders 19, which are arranged in holes in the lower unit 7 to raise and lower the member 18 in accordance with the previous function description.

When the width w of the units 6, 7 is large, it is understood that a plurality of clothing manipulators may be used, the manipulators being arranged one after the other along the clothing advancement direction F.

The outer actuator 10 and the inner actuator 11 are preferably identical, each comprising an elongated actuator member 20 having an essentially flat upper surface. Each actuator member 20 preferably has a width in the range of 25 to 35% of the width w of the unit 7 and a length in the range of 80 to 90% of the length l of the unit 7, which gives the actuator member 20 a sufficiently large surface area not to damage the clothing during the phases where the actuator 10 and 11, respectively, carries the load of the vertical beam. The actuator members 20 are preferably made of steel. Each outer and inner actuator 10, 11 also comprises three hydraulic cylinders 21, which are arranged in holes in the second unit 7 to raise and lower the respective member 20 in accordance with the previous function description.

It is understood that alternative embodiments of the actuators 10, 11 and the manipulator 12 are within the scope of the invention. For example, it is understood that the apparatus should be dimensioned taking into account the weight it should withstand in each case. Depending on the application, the weight that the apparatus could be subjected to can be up to 40 to 50 tons or even higher. It is understood that the area of the interacting surfaces of the units 6, 7 and the activators 10, 11 should be adapted so that the clothing locked or squeezed therebetween will not be damaged.

The actuators 10, 11 and the manipulator 12 are preferably covered with a flexible and elastic protective member 22 which serves the dual purpose of protecting the clothing from hydraulic fluids and oil from the cylinders 19 and 21, and protecting the cylinders 19 and 21 from moisture and particles which may follow the clothing when it enters the apparatus 5 during the clothing advancement operation. Alternatively, the protective member 22 may cover only the actuator members 20 but not the member 18. The protective member 22 is preferably made of a polymer, e.g. rubber, or any other suitable flexible and elastic material which provide a protective surface for the clothing. As can be seen in FIG. 3*b*, if the protective member 22 is to cover the manipulator 12, the protective member 22 needs to be sufficiently elastic to allow the travel of the manipulator 12 as well as the actuators 10 and 11.

The travel of the clothing manipulator 12 determines the distance by which the clothing is advanced through the apparatus during each pull-push cycle. If the travel is too small, on one hand, an excessive number of pull-push cycles are required to bring the clothing through the apparatus. If the travel is too large, on the other hand, the clothing may get stuck in the apparatus during the push phase of the cycle. Experiments have revealed that a travel within the range of 50 to 150 mm, and preferably within 80 to 100 mm, provides an advancement rate per pull-push cycle which is both efficient and reliable for most types of clothing.

The travel of the inner and outer actuators 10 and 11 needs to be sufficient to allow the clothing to pass between the actuator 10 and 11, respectively, and the upper unit 6 when the respective actuator 10, 11 is in its lowermost position. Therefore, the thinner the clothing, the smaller the size of the gap and, consequently, the smaller the stroke length required. The gap size should preferably not exceed the thickness of the operator's fingers in order to prevent the operator from accidentally placing his hand or fingers in the gap. A small gap size is also advantageous in view of the weight the apparatus needs to withstand. However, when the thickness of the clothing is larger than the thickness of the operator's fingers, other known safety measures should preferably be provided in order to prevent the operator from placing his hand in the gap. In a paper machine, a travel of the actuators 10 and 11 within the range of 5 to 15 mm, preferably within 8 to 12 mm, has proved to be suitable.

The recess 14 in the upper unit 6 needs to be sufficiently deep and wide to accommodate the clothing manipulator 12 and the clothing (not shown in FIG. 3*b*) accumulated in the recess 14 when the actuator 12 is raised. Preferably, the edges 23 of the recess 14 are rounded in order to provide a smooth, non-damaging surface for the clothing.

Figure 4:
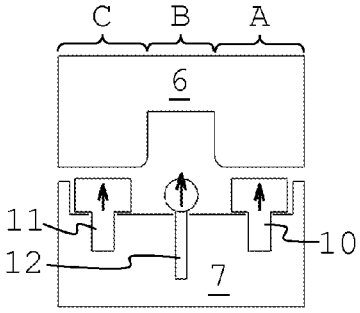
FIG. 4 is a schematic, cross-sectional view of a two-actuator apparatus according to the same embodiment of the invention as shown in FIGS. 2*a* to 2*w;*
Figure 5:
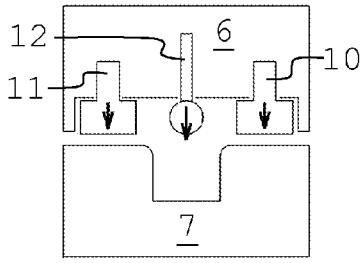
FIGS. 5 to 9 are schematic, cross-sectional views showing different embodiments of a two-actuator apparatus according to alternative embodiments of the invention.
Figure 6:
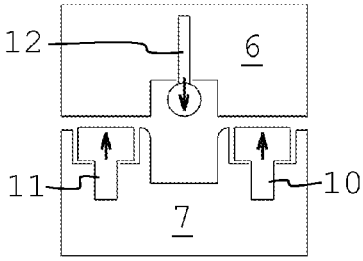
Figure 7:
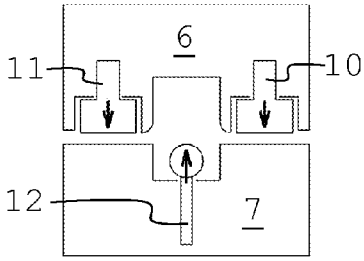
Figure 8:
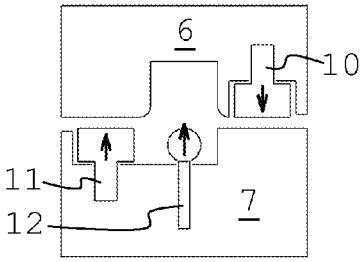
Figure 9:
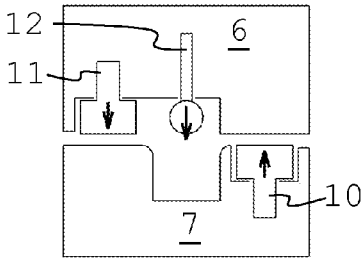

FIGS. 5 to 9 show alternative embodiments of an apparatus according to the invention having two actuators. FIG. 4 shows the embodiment previously discussed in relation to FIGS. 2*a* to 2*w*. However, it is possible to achieve the same pull-push effect as described above by arranging the actuators in a different manner. In FIG. 5 an embodiment is shown where the actuators 10 and 11 and the clothing manipulator 12 are arranged in the upper unit 6. In FIG. 6 an embodiment is shown where the outer and inner actuators 10 and 11 are arranged in the lower unit 7 and the manipulator 12 is arranged in the upper unit 6. In FIG. 7 an embodiment is shown where the outer and inner actuators 10 and 11 are arranged in the upper unit 6 and the manipulator 12 is arranged in the lower unit 6. In FIG. 8 an embodiment is shown where the inner actuator 11 and the manipulator 12 are arranged in the lower unit 7 and the outer actuator 10 is arranged in the upper unit 6. As an alternative to this embodiment (not shown), the manipulator 12 may be arranged in the upper unit 6 instead of in the lower unit 7. In FIG. 9 an embodiment is shown where the inner actuator 11 and the manipulator 12 are arranged in the upper unit 6 and the outer actuator 10 is arranged in the lower unit 7. As an alternative to this embodiment (not shown), the manipulator 12 may be arranged in the lower unit 7 instead of in the upper unit 6. For the alternative embodiments shown in FIGS. 5 to 9, the clothing advancement action is brought about by raising and lowering the actuators 10 and 11 and the manipulator 12 in the same sequence as previously discussed above in relation to FIGS. 2*a* to 2*w*.

Figure 10A:
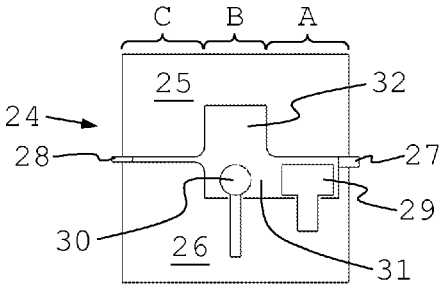
FIGS. 10*a* to 10*w* are schematic, cross-sectional views showing the operation of a one-actuator apparatus according to one embodiment of the invention.
Figure 10B:
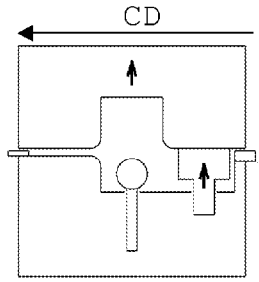
Figure 10C:
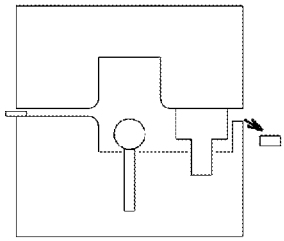
Figure 10D:
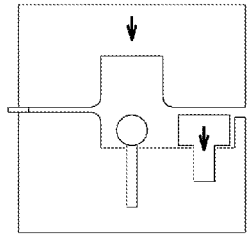
Figure 10E:
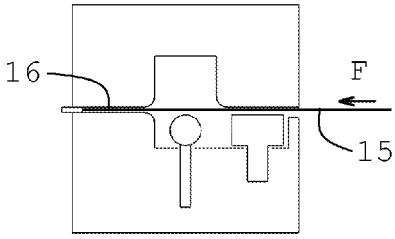
Figure 10F:
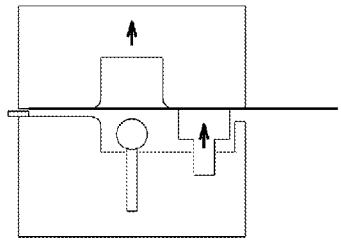
Figure 10G:
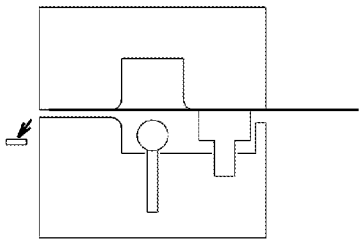
Figure 10H:
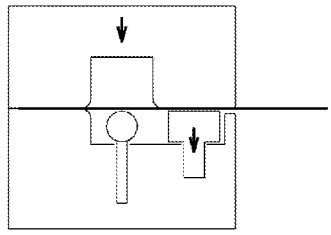
Figure 10I:
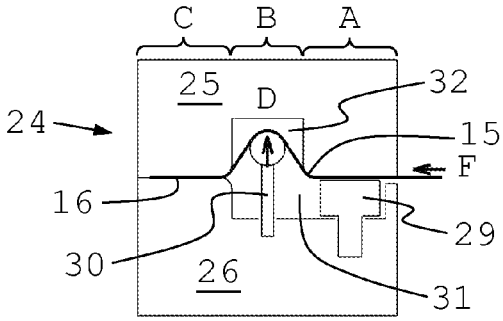
Figure 10J:
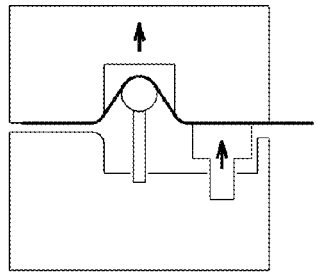
Figure 10K:
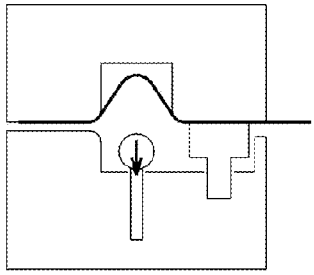
Figure 10L:
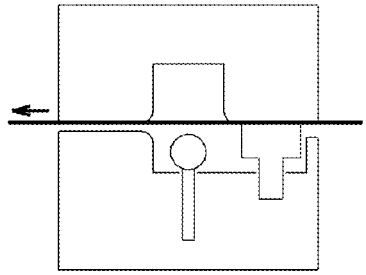
Figure 10M:
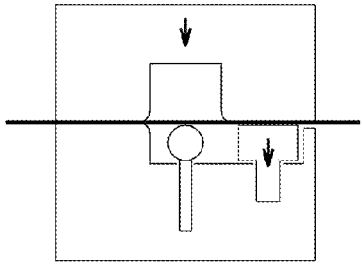
Figure 10N:
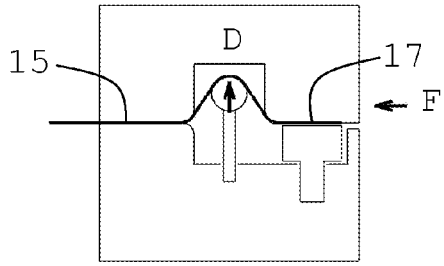
Figure 10O:
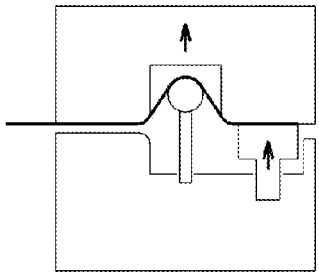
Figure 10P:
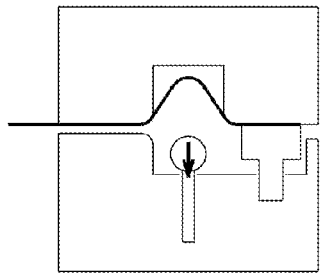
Figure 10Q:
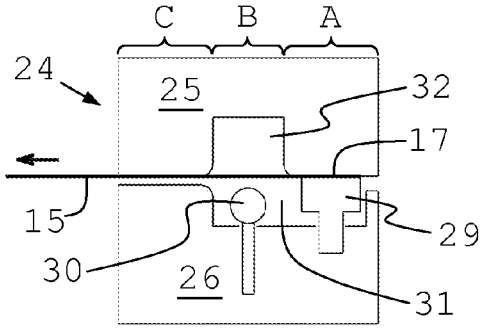
Figure 10R:
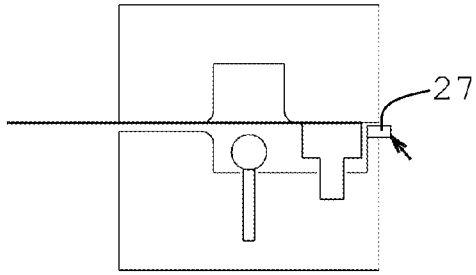
Figure 10S:
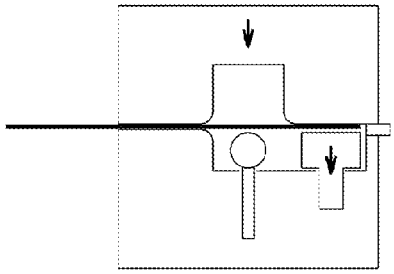
Figure 10T:
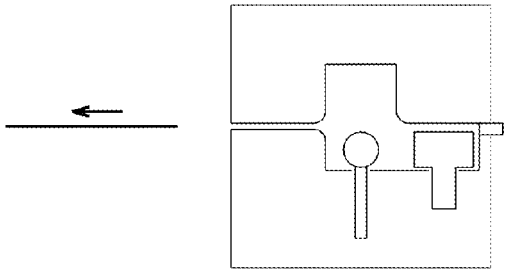
Figure 10U:
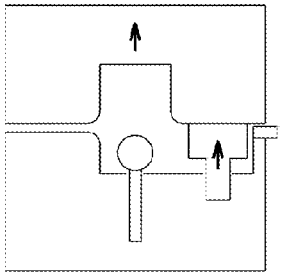
Figure 10V:
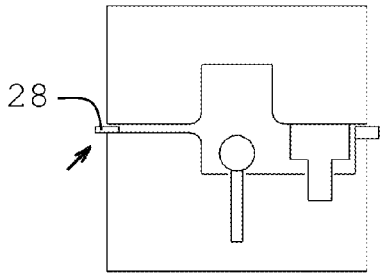
Figure 10W:
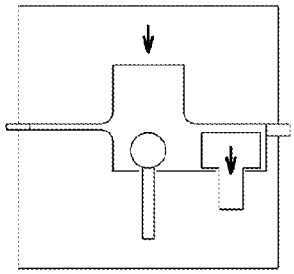

FIGS. 10*a* to 10*w* show another embodiment of an apparatus 24 according to the invention. The apparatus 24 comprises a first, upper unit 25 and a second, lower unit 26. The upper unit 25 is rigidly attached to an upper section of a vertical beam. If used in the frame section of FIG. 1, this upper section may be 3*a*, 3*b* or 3*c*, depending on the position of the apparatus 24. The lower unit 26 is rigidly attached to the corresponding lower section 3*b*, 3*c* or 3*d* of the vertical beam. The apparatus 24 also comprises a first, outer spacer 27 and a second, inner spacer 28, which spacers 27, 28 are arranged between the upper and lower units 25, 26 when the apparatus 24 is inactive.

In the cross direction CD the apparatus 24 is divided into a first, outer section or zone A, a middle section or zone B and an inner section or zone C (see FIGS. 10*a*, 10*i* and 10*q*).

The lower unit 26 comprises an outer actuator 29 arranged in the outer zone A and a clothing manipulator 30 arranged in the middle zone B. The actuator 29 and the manipulator 30 are arranged in an upwardly open recess 31 in the lower unit 26. Opposite the manipulator actuator 30, the upper unit 25 comprises a downwardly open recess 32.

The operation of the apparatus 24 will be described in the following with reference to FIGS. 10*a* to 10*w*.

FIG. 10*a* shows the apparatus 24 in an inactive position prior to a clothing replacement operation. In this position, the load of the upper beam section is transferred to the lower beam section via the upper unit 25, the spacers 27, 28 and the lower unit 26.

Before a new clothing can be mounted in the processing section of the paper machine, the old clothing has to be removed, e.g. by operators cutting the old clothing and running the clothing out of the processing section using the support rolls of the processing section. Alternatively, the old clothing can be removed by using the apparatus 24 in a reversed mode, as will be disclosed later.

When the old clothing has been removed from the processing section, the initial phase of the advancement operation of the new clothing can commence. The operator raises the outer actuator 29 in such a way that the actuator 29 is brought in contact with the downwardly facing surface of the upper unit 25 and raises the upper unit 25, as is shown in FIG. 10*b*, unloading the spacers 27, 28. Thereafter, the operator removes the outer spacer 27, as is shown in FIG. 10*c*, and lowers the actuator 29, as is shown in FIG. 10*d*, whereby the upper unit 25 comes to rest on the inner spacer 28. Thereafter, the operator feeds the new clothing 15 in a advancement direction F (see FIG. 10*e*) into the gap formed between the upper and lower units 25, 26 such that the drive side edge 16 of the new clothing 15 is brought between the upper and lower units 25, 26 and preferably in contact with the inner spacer 28, as is shown in FIG. 10*e*. Thereafter, the operator raises the outer actuator 29 in such a way that the outer actuator 29 is brought in contact with the clothing 15, locks the clothing 15 between the actuator 29 and the downwardly facing surface of the upper unit 25 and raises the upper unit 25, as is shown in FIG. 10*f*, thus unloading the inner spacer 28. Thereafter, the operator removes the inner spacer 28, as is shown in FIG. 10*g*, and lowers the outer actuator 29 such that the clothing 15 is locked between the opposing surfaces of the upper and lower units 25, 26, as is shown in FIG. 10*h*. This step concludes the initial phase of the clothing advancement operation.

In the second phase of the advancement operation, a series of steps are performed that define a pull-push cycle or sequence which is repeated until the tender side edge 17 (see FIG. 10*n*) of the clothing 15 is pulled into the apparatus 24. At the start of the second phase, the situation is as shown in FIG. 10*h*, i.e. the upper unit 25 and the lower unit 26 are brought to cooperate in the inner zone C such that the load of the beam is carried by the third zone C and the clothing 15 is locked between the opposing surfaces of the upper unit 25 and the lower unit 26. The first step in this phase is shown in FIG. 10*i*. The clothing manipulator 30 is raised in a direction D such that the manipulator 30 is brought into the recess 32 of the upper unit 25. Since the clothing 15 is locked between the upper and lower units 25, 26 and since the direction D is essentially orthogonal to the advancement direction F, the raising of the manipulator 30 will cause the clothing 15 outside of the frame section 1 to be pulled into the first and second zones A and B of the apparatus 24, as is shown in FIG. 10*i*. Thus, the manipulator 30 acts as a pull actuator, pulling the clothing into the apparatus 24. Next, the operator raises the outer actuator 29 in such a way that the outer actuator 29 is brought in contact with the clothing 15 and locks the clothing 15 between the actuator 29 and the downwardly facing surface of the upper unit 25, as is shown in FIG. 10*j*, such that the load of the beam is transferred to the first zone A and the clothing 15 in the third zone C is released. Thereafter, the manipulator 30 is lowered, as is shown in FIG. 10*k*. When the manipulator 30 is lowered, the clothing 15 will normally automatically strive to recover its flat form due to the inherent elasticity and stiffness of the clothing 15, causing the drive side of the clothing 15 to be pushed out of the apparatus 24, as is shown in FIG. 101. However, the operator may have to assist this step by pulling the drive end of the clothing 15. Alternatively, the apparatus 24 may comprise a push actuator (not shown), which is arranged in the upper unit 25 opposite to the manipulator 30 and is arranged to actively push the clothing out of the apparatus 24 by means of a downward motion. When the clothing 15 has been pushed out of the apparatus 24 and consequently has recovered its flat form, the outer actuator 29 is lowered, as is shown in FIG. 10*m*, bringing the apparatus 24 to the same position as in FIG. 10*h*. The pull-push cycle shown in FIGS. 10*i* to 10*m* is repeated until the tender side 17 of the clothing 15 is pulled into the apparatus 24, as is shown in FIGS. 10*n* to 10*q*, at which point the second phase of the clothing advancement operation has been carried through.

In the third and final phase of the advancement operation, the outer spacer 27 is placed in its original position, as is shown in FIG. 10*r*, and the outer actuator 29 is lowered, as is shown in FIG. 10*s*. This leaves the upper unit 25 resting on the outer spacer 27, allowing the operator to pull the trailing end of the clothing 15 out of the apparatus 24, as is shown in FIG. 10*t*. Finally, the operator reinstitutes the inactive position of the apparatus 24 by raising the upper unit 25 by means of raising the outer actuator 29, as is shown in FIG. 10*u*, placing the inner spacer 28 in its original position, as is shown in FIG. 10*v*, and lowering the actuator 29 leaving the upper unit 25 to rest on the spacers 27, 28, as is shown in FIG. 10*w*.

All these steps could alternatively be performed automatically without any operator input or with only limited operator input. For example, the operator input could be limited to initializing and terminating the step sequence.

It is to be understood that in an embodiment having only one actuator, as is the case for the apparatus 24, the upper unit 25 and/or the lower unit 26 needs to perform an up-down movement during each push-pull cycle.

Figure 11:
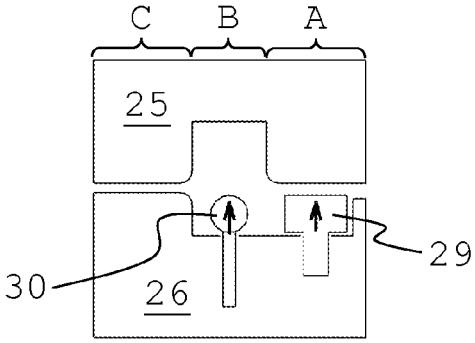
FIG. 11 is a schematic, cross-sectional view of a one-actuator apparatus according to the same embodiment of the invention as shown in FIGS. 10*a* to 10*w;*
Figure 12:
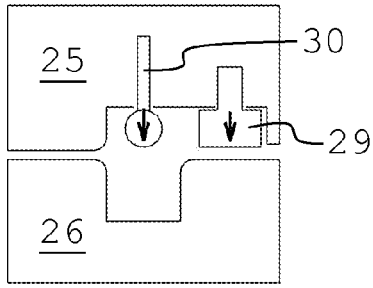
FIGS. 12 to 14 are schematic, cross-sectional views showing different embodiments of a one-actuator apparatus according to the invention.
Figure 13:
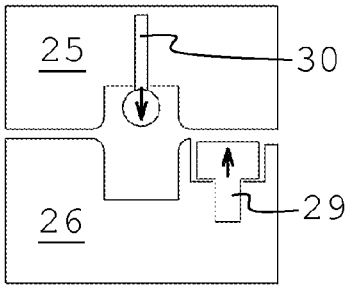
Figure 14:
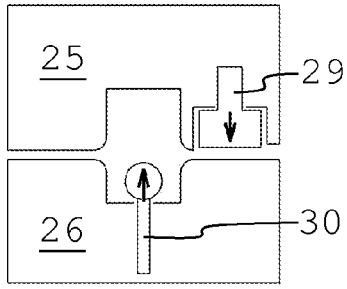

FIGS. 12 to 14 show alternative embodiments of an apparatus according to the invention having one actuator 29 and one clothing manipulator 30. FIG. 11 shows the embodiment previously discussed in relation to FIGS. 10*a* to 10*w*. However, it is possible to achieve the same pull-push effect as described above by arranging the actuator 29 and the manipulator 30 in a different manner. For example, it is possible to arrange the actuator 29 in the third zone C instead of in the first zone A.

In FIG. 12 an embodiment is shown where the actuator 29 and the manipulator 30 are arranged in the upper unit 25. In FIG. 13 an embodiment is shown where the outer actuator 29 is arranged in the lower unit 26 and the manipulator 30 is arranged in the upper unit 25. In FIG. 14 an embodiment is shown where the outer actuator 29 is arranged in the upper unit 25 and the manipulator 30 is arranged in the lower unit 26. For the alternative embodiments shown in FIGS. 12 to 14 the clothing advancement action is brought about by raising and lowering the actuator and the manipulator in the same sequence as previously discussed above in relation to FIGS. 10*a* to 10*w*.

It is understood that having only one actuator may be advantageous because in such cases hydraulic pipings or control wires need only be run to one side of the apparatus.

FIGS. 15*a* to 15*g* show a further embodiment of an apparatus 33 according to the invention. The apparatus 33 comprises a first, upper unit 34 and a second, lower unit 35 (see FIG. 15*a*). In the cross direction CD the apparatus 33 is divided into a first, outer section or zone A, a middle section or zone B and an inner section or zone C. The lower unit 35 comprises a first, outer actuator 36 arranged in the outer zone A and a second, inner actuator 37 arranged in the inner zone C. The lower unit 35 comprises a first, outer recess 38 in which the actuator 36 is arranged and also a second, inner recess 39 in which the actuator 37 is arranged. Between the recesses 38, 39, the lower unit 35 comprises a third, middle recess 40 arranged in the middle zone B.

The upper unit 34 is essentially block shaped.

The apparatus 33 further comprises a first, outer pair of rolls 41 and a second, inner pair of rolls 42. Each pair of rolls 41, 42 comprises a first, upper roll 43 and a second, lower roll 44, the rolls 43, 44 being arranged such that their axes of rotation are horizontal and parallel and such that their envelope surfaces form a nip for the clothing 15. The outer pair of rolls 41 is positioned upstream of the outer zone A and the inner pair of rolls is positioned downstream of the inner zone C when viewed in the clothing advancement direction F.

The apparatus 33 also comprises spacers (not shown) which construction and function are essentially identical to the spacers 8, 9 described above in relation to the apparatus 5. When operating the apparatus 33, the initial phase of the advancement operation is essentially identical to the initial phase described above in relation to the apparatus 5, with the exception that the outer and inner pair of rolls 41, 42 and not manual advancement are used to feed the clothing 15 into the apparatus 33.

Figure 15A:
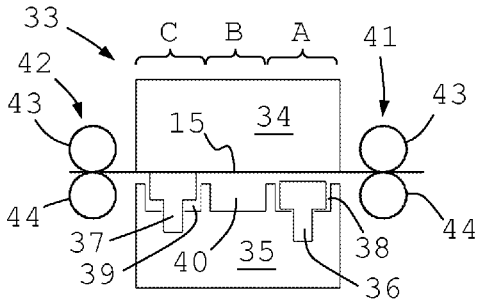
FIGS. 15*a* to 15*g* are schematic, cross-sectional views showing the operation of a roll actuator apparatus according to a further embodiment of the invention.

In the second phase of the advancement operation, a series of steps are performed that define a push-pull cycle which is repeated until the tender side edge of the clothing 15 is pulled into the apparatus 33. At the start of the second phase, the situation is as shown in FIG. 15*a*, i.e. the upper unit 34 and the lower unit 35 are brought to cooperate in the third zone C such that the load of the beam is carried by the third zone C and the clothing 15 is locked between the inner actuator 37 and the upper unit 34.

Figure 15B:
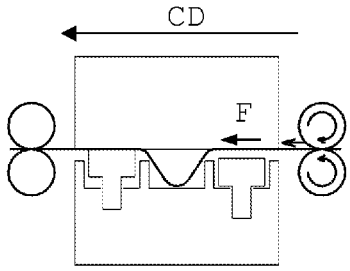

The first step in this second phase is shown in FIG. 15*b*. The outer pair of rolls 41 is brought to rotate such that the clothing 15 is fed in the advancement direction F. Since the clothing 15 is locked between the inner actuator 37 and the upper unit 34, the clothing will crease and create a fold or loop in the recess 40. Thus, the outer pair of rolls 41 acts as a push actuator, pushing the clothing 15 into the apparatus 33.

When a predetermined length of clothing has been fed into the apparatus 33, preferably 50 to 300 millimetres depending on the physical properties of the clothing and the size of the recess 40, the rotating action of the outer pair of rolls 41 is stopped.

Figure 15C:
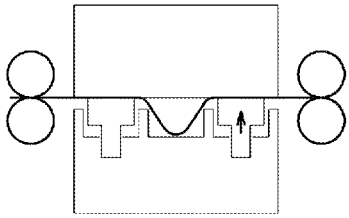
Figure 15D:
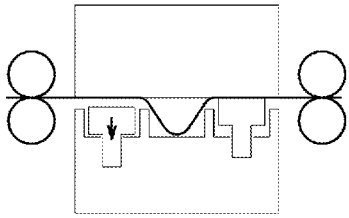

Next, the outer actuator 36 is raised in such a way that the actuator 36 is brought into contact with the clothing 15 and locks the clothing 15 between the actuator 36 and the downwardly facing surface of the upper unit 34, as is shown in FIG. 15*c*. Thereafter, the inner actuator 37 is lowered, as is shown in FIG. 15*d*. When the inner actuator 37 is lowered, the load of the beam is transferred to the first zone A and the clothing 15 in the third zone C is released.

Figure 15E:
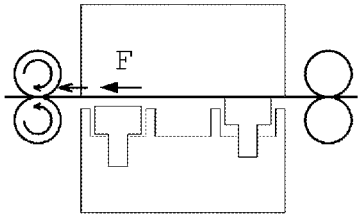

Thereafter, the inner pair of rolls 42 is brought to rotate, pulling the clothing 15 such that the slack of the clothing accumulated in the recess 40 is taken out, as is shown in FIG. 15*e*. Thus, the inner pair of rolls 42 acts as a pull actuator, pulling the clothing 15 out of the apparatus 33. Consequently, the rotational action of the inner pair of rolls 42 should bring about the same amount of clothing advancement as the rotational action of the outer pair of rolls 41.

Figure 15F:
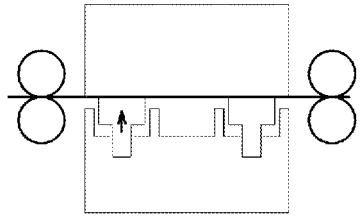
Figure 15G:
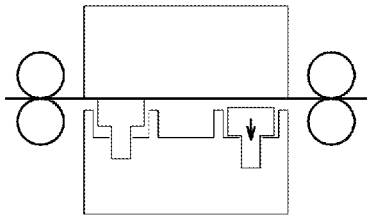

When the slack of the clothing 15 has been taken out and the clothing 15 as a consequence has recovered its flat form, the inner actuator 37 is again raised, as is shown in FIG. 15*f*, and the outer actuator 36 is lowered, as is shown in FIG. 15*g*, bringing the apparatus 33 to the same position as in FIG. 15*a*. The push-pull cycle shown in FIGS. 15*a* to 15*g* is repeated until the tender side of the clothing 15 is pulled into the apparatus 33, at which point the second phase of the clothing advancement operation has been carried through.

In order to increase the capacity of the apparatus 33, it is understood that a second recess for the clothing 15, facing the recess 40, may be arranged in the upper unit 34, whereby the length of clothing 15, which can be accommodated in the middle zone B during each push-pull cycle, can be increased. Alternatively, only the upper unit 34 may comprise a recess for the clothing 15.

In the third and final phase of the advancement operation, the outer spacer (not shown) is placed between the upper and lower units 34, 35 outside of the outer actuator 36 prior to the outer actuator 36 being lowered. This leaves the upper unit 34 resting on the outer spacer, allowing the inner pair of rolls 42 to pull the trailing end of the clothing 15 out of the apparatus 33.

Above, the function of the invention has been described from the standpoint of mounting a clothing in a web forming or web processing machine. However, the invention is also fully capable of removing a clothing from such a machine simply by reversing the above-described steps. Consequently, instead of removing the old clothing from the machine by cutting the clothing and thus damaging it, the operator may alternatively use the apparatus according to the invention in a reversed mode, whereby the old clothing can be removed without having to be severed. This feature is advantageously exploited in cases where the old clothing is to be reused, e.g. after cleaning, repair or modification. Thus, the advancement direction F mentioned above can be a clothing mounting direction or a clothing removal direction.

The apparatus according to the invention can be permanently mounted in a beam of the frame structure of the paper machine. Alternatively, the frame structure may comprise beam spacer blocks (not shown) which can be removed to make room for a mobile apparatus. Such a mobile apparatus can be moved between different positions in the frame structure and also between different frame structures. Preferably, the mobile apparatus comprises carrying means arranged to cooperate with corresponding engagement means of a suitable carrying device.

Figure 16A:
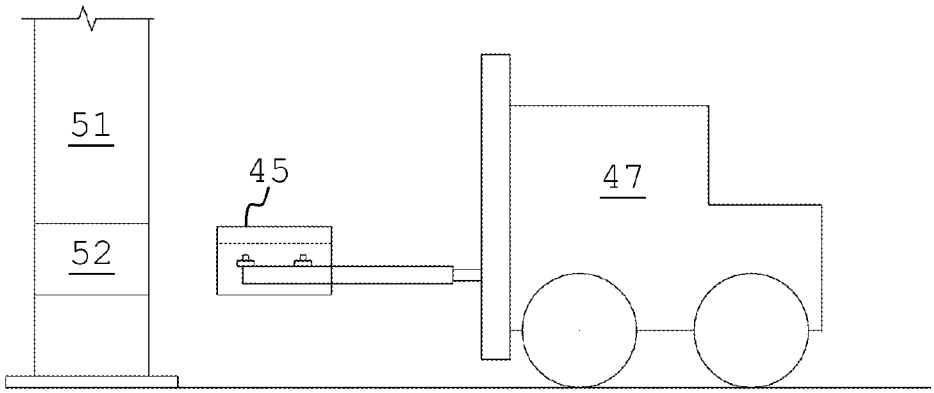
FIGS. 16*a* to 16*c* are schematic views illustrating the operation of a mobile apparatus according to the invention.
Figure 16B:
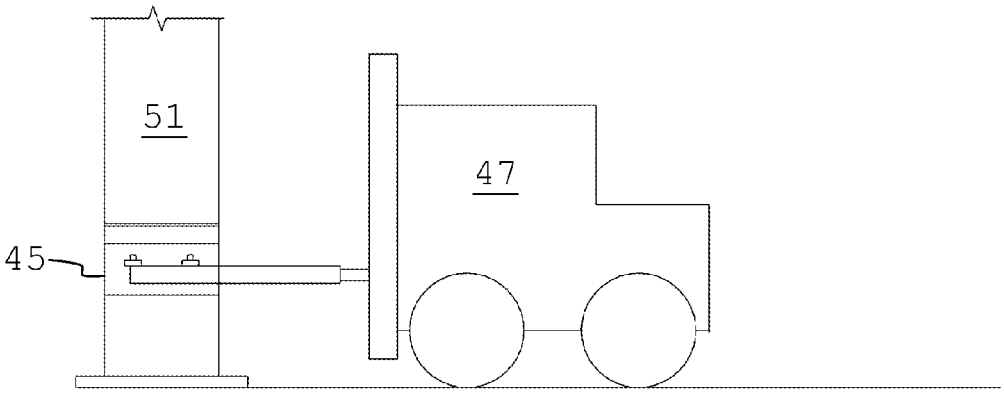
Figure 16C:
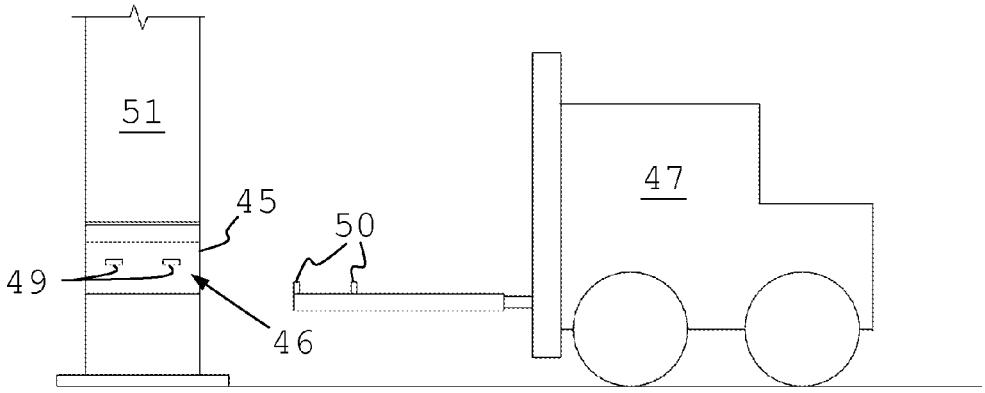
Figure 17A:
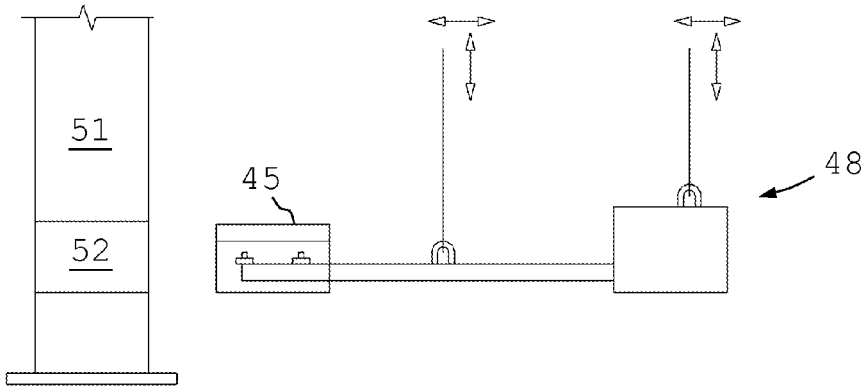
FIGS. 17*a* to 17*c* are schematic views illustrating an alternative operation of a mobile apparatus according to the invention.
Figure 17B:
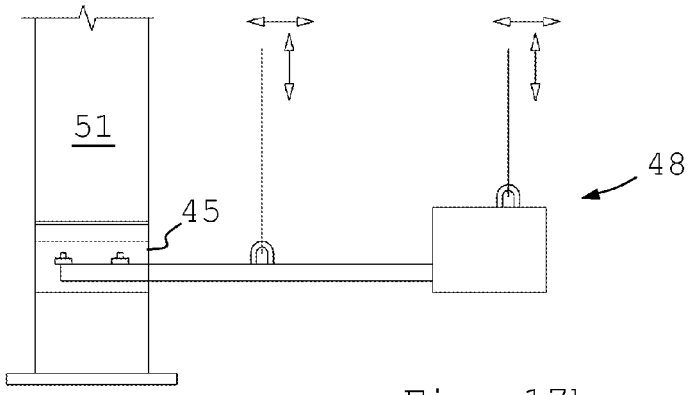
Figure 17C:
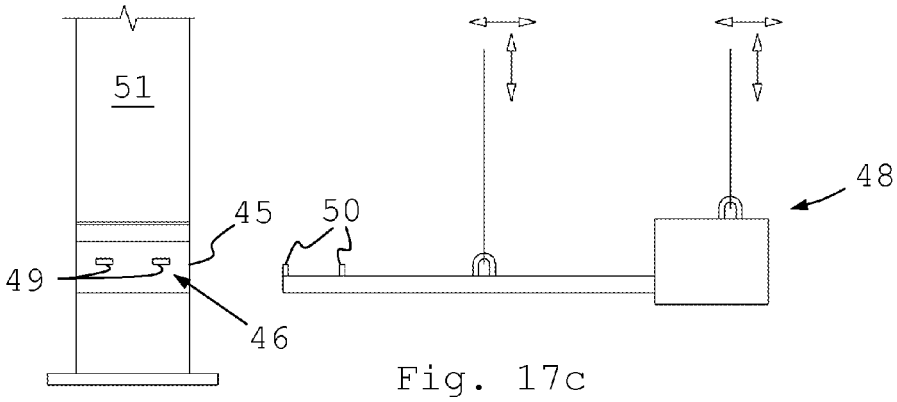

FIGS. 16*a* to 16*c* and 17*a* to 17*c* show such a mobile 45. The apparatus 45 comprises carrying means 46, by which the apparatus 45 easily can be moved using a suitable moving device, e.g. a fork lift 47, as shown in FIGS. 16*a* to 16*c*, or a overhead travelling crane 48, as shown in FIGS. 17*a* to 17*c*. The carrying means 46 comprises a pair of horizontally orientated lug handles 49 welded to each side of the apparatus 45. The lug handles 49 are arranged to cooperate with corresponding engagement means 50, e.g. pins, of the moving device 47, 48.

Prior to mounting the apparatus 45 in a beam 51, the beam 51 is unloaded, e.g. by using external jacks or a counter-lever system, and a beam spacer block (not shown) having essentially the same height as the apparatus 45 is removed, leaving a gap 52 in the beam 51, as is shown in FIGS. 15*a* and 16*a*. Thereafter, the moving device 47, 48, respectively, is used to place the apparatus 45 in the gap 52, as is shown in FIGS. 15*b* and 16*b*. After the apparatus 45 has been placed in the gap 52, the beam is reloaded such that the load of the beam 51 is carried by the apparatus 45, as is shown in FIGS. 15*c* and 16*c*. Once in place, the apparatus 45 can be operated as has been described above in order to pass a clothing through or by the beam.

Furthermore, it is understood that the mobile apparatus needs not be placed in a beam in order to function. The apparatus can alternatively be used in a stand-alone mode, in which case the apparatus is positioned alongside the industrial machine in which the clothing is to be replaced. The exchange operation is then carried through in the same manner as has been disclosed above.

Above, the invention has been disclosed with reference to a web forming or processing machine and to a selected and limited number of different embodiments. However, the skilled person will readily recognise that other embodiments and variations of the embodiments are possible within the scope of the invention as defined in the following claims. For example, as an alternative to hydraulic cylinders, the actuators 10, 11 and 12 may comprise pneumatic cylinders or other types of actuating devices known in the art. Also, as an example, it is understood that the intermediate zone B may comprise two opposing clothing manipulators, one acting to feed the clothing into the apparatus and one acting to feed the clothing out of the apparatus. Furthermore, it is understood that the apparatus may comprise any combination of clothing manipulator and pair of rolls acting together to feed the clothing into and out of the apparatus.

Also, the skilled person will readily recognise that the apparatus according to the invention can be used for mounting or removing an endless clothing in all types of industrial machines, not only web forming or web processing machines.

Furthermore, it is understood that the apparatus according to the invention can be used to remove or mount a clothing when modifying or re-building an industrial machine and also that industrial machines can be retrofitted with an apparatus according to the invention.

The invention claimed is:

1. An apparatus for inserting a flexible clothing in or removing such a clothing from an industrial machine in which the clothing is arranged to run in an endless loop, comprising:

a first structural unit and a second structural unit being arranged opposite to each other, said apparatus being arranged to feed the clothing between the first unit and the second unit in a clothing advancement direction essentially transverse to the run direction of the clothing in the machine;

wherein the apparatus comprises:

an upstream zone, an intermediate zone and a downstream zone being arranged one after the other along the advancement direction of the clothing; and at least one first member being arranged for bringing the first unit and the second unit to interact with each other in the upstream zone and the downstream zone, alternately, such that the clothing is arrested between the first unit and the second unit in the upstream zone and the downstream zone, alternately, allowing the feeding of a predetermined breadth of the clothing into the upstream zone when the clothing is arrested between the first unit and the second unit in the downstream zone such that a breadth of clothing corresponding to said predetermined breadth of clothing is accumulated in the intermediate zone, and allowing the feeding of the clothing accumulated in the intermediate zone into the downstream zone when the clothing is arrested between the first unit and the second unit in the upstream zone such that a breadth of clothing corresponding to said predetermined breadth of clothing is fed out of the apparatus through the downstream zone.

2. The apparatus according to claim 1, further comprising at least one second member being arranged for said feeding of said predetermined breadth of clothing into the upstream zone.

3. The apparatus according to claim 2, wherein said at least one second member comprises a clothing manipulator, which is arranged in said second zone for displacing the clothing in a direction which is orthogonal to the advancement direction of the clothing.

4. The apparatus according to claim 2, wherein said at least one second member comprises a first pair of rolls forming a nip for the clothing.

5. The apparatus according to claim 4, wherein the first pair of rolls is positioned upstream of the first zone.

6. The apparatus according to claim 4, wherein said at least one third member comprises a second pair of rolls forming a nip for the clothing.

7. The apparatus according to claim 6, wherein the second pair of rolls is positioned downstream of the third zone.

8. The apparatus according to claim 1, further comprising at least one third member being arranged for said feeding of said predetermined breadth of clothing out of the apparatus through the downstream zone.

9. The apparatus according to claim 1, wherein said at least one first member comprises an actuator being arranged in the first zone or the third zone and being operable in a direction which is orthogonal to the advancement direction of the clothing.

10. The apparatus according to claim 9, wherein said actuator or actuators comprise a hydraulic cylinder.

11. The apparatus according to claim 1, wherein said at least one first member comprises a first actuator being arranged in the first zone and a second actuator being arranged in the third zone, said actuators being operable in a direction which is orthogonal to the advancement direction of the clothing.

12. The apparatus according to claim 11, wherein the first and second actuators are arranged in the first unit.

13. The apparatus according to claim 11, wherein the first actuator is arranged in the first unit and the second actuator is arranged in the second unit.

14. The apparatus according to claim 1, wherein at least one of the first unit and the second unit comprises a recess in the second zone for accommodating the section of the clothing accumulated in the second zone.

15. The apparatus according to claim 1, wherein said feeding of the clothing accumulated in the intermediate zone into the downstream zone is brought about by the inherent elasticity of the clothing.

16. The apparatus according to claim 1, wherein the apparatus comprises carrying means by which the apparatus can be moved between different locations on the industrial machine or between different industrial machines.

17. An industrial machine comprising means for leading a flexible clothing in an endless loop through the machine, wherein it comprises at least one apparatus according to claim 1 for inserting the clothing in or removing the clothing from the machine.

18. The machine according to claim 17, wherein it comprises a frame structure comprising support rolls for leading the endless, flexible clothing in the endless loop through the machine, wherein said at least one apparatus is mounted in the frame structure of the machine.

19. The machine according to claim 18, wherein the frame structure comprises a first beam section and a second beam section of a beam, and in that said at least one apparatus is arranged in the beam such that the first unit of said at least one apparatus is arranged to cooperate with the first beam section and such that the second unit of said at least one apparatus is arranged to cooperate with the second beam section, wherein said at least one apparatus is arranged to carry the load of the beam when the clothing is fed through the apparatus.

20. The machine according to claim 19, wherein the machine is a paper web forming or web processing machine.

21. The machine according to claim 17, wherein the clothing is a woven clothing.

22. The machine according to claim 17, wherein the clothing is made of one of a polymer, a metal or a composite material.

23. The machine according to claim 17, wherein the clothing is a metal strip or band.

24. The machine according to claim 17, wherein the clothing is made of a plurality of flat elements interconnected to form a band.

25. A method of inserting a flexible clothing in or removing such a clothing from an industrial machine, wherein the clothing is fed through an apparatus in a clothing advancement direction which is essentially transverse to the run direction of the clothing in the machine, which apparatus comprises a first structural unit and a second structural unit being arranged opposite to each other, between which units the clothing is fed, and which apparatus displays an upstream zone, an intermediate zone and a downstream zone being arranged one after the other along the clothing advancement direction, the method comprising the steps of:

positioning the apparatus alongside the machine;

feeding a long side edge of the clothing into the apparatus; and repeating the sequence of:

arresting the clothing between the first unit and the second unit in the downstream zone and releasing the clothing in the upstream zone;

feeding a predetermined breadth of the clothing into the upstream zone such that a breadth of clothing corresponding to said predetermined breadth of clothing is accumulated in the intermediate zone;

arresting the clothing between the first unit and the second unit in the upstream zone and releasing the clothing in the downstream zone; and feeding the clothing accumulated in the intermediate zone into the downstream zone such that a breadth of clothing corresponding to said predetermined breadth of clothing is fed out of the apparatus through the downstream zone.

26. The method according to claim 25, wherein the steps of arresting and releasing the clothing are brought about by operating at least one actuator being arranged in the upstream zone and/or the downstream zone in an operating direction which is orthogonal to the advancement direction of the clothing.

27. The method according to claim 25, wherein the step of feeding the clothing into the upstream zone and accumulating the clothing in the intermediate zone are brought about by operating a clothing manipulator being arranged in the intermediate zone in a direction which is orthogonal to the advancement direction of the clothing.

28. The method according to claim 25, wherein the step of feeding the clothing into the upstream zone and accumulating the clothing in the intermediate zone are brought about by operating a pair of rolls forming a nip for the clothing, which pair of rolls is positioned upstream of the upstream zone.

29. The method according to claim 28, wherein the step of feeding the clothing out of the downstream zone is brought about by operating a second pair of rolls forming a nip for the clothing , which second pair of rolls is positioned downstream of the downstream zone.

30. A method of retrofitting an industrial machine comprising a frame structure and an endless clothing running in an endless loop through the machine, the method comprising the step of:

mounting at least one apparatus according to claim 1 in the frame structure of the machine.

* * * * *